US006036819A

United States Patent [19]

Miller et al.

[11] Patent Number: 6,036,819

[45] Date of Patent: Mar. 14, 2000

[54] METHOD FOR IMPROVING THE CLEANABILITY OF COATED BELTS WITH A NEEDLED WEB ON THE INSIDE SURFACE

[75] Inventors: Lawrence G. Miller, Plymouth; Joseph Salitsky; Karen L. Crawford, both of Mansfield, all of Mass.

[73] Assignee: Albany International Corp., Albany, N.Y.

[21] Appl. No.: 09/106,656

[22] Filed: Jun. 29, 1998

[51] Int. Cl.[7] ..... D21F 3/00

[52] U.S. Cl. ..... 162/358.2; 442/270; 442/275; 442/276; 442/277; 442/281; 442/387; 442/388; 162/900

[58] Field of Search ..... 162/358.2, 900; 442/270, 275, 276, 277, 281, 387, 388

[56] References Cited

U.S. PATENT DOCUMENTS 4,565,735 1/1986 Murka, Jr. et al. ..... 428/234

5,298,124 3/1994 Eklund et al. ..... 162/306

*Primary Examiner*—Christopher Raimund

*Attorney, Agent, or Firm*—Kane, Dalsimer, Sullivan and Levy, LLP

[57] ABSTRACT

A polymeric-resin-coated papermaking-processing belt, which may be used as a sheet-transfer, long nip press (LNP) or calender belt, includes a reinforcing base having the form of an endless loop with a face side and a back side, these being the outside and inside of the endless loop, respectively. The face side of the reinforcing base is coated with a polymeric resin material, while the back side has a staple fiber batt attached thereto. The staple fiber batt has a smooth, fused surface free of protruding fiber ends. This surface is kept clean more easily than that of a typical staple fiber batt. Methods for manufacturing the polymeric-resin-coated papermaking-processing belt, including several ways for providing the staple fiber batt with the smooth, fused surface, are also disclosed.

23 Claims, 4 Drawing Sheets

METHOD FOR IMPROVING THE CLEANABILITY OF COATED BELTS WITH A NEEDLED WEB ON THE INSIDE SURFACE

BACKGROUND OF THE INVENTION

1. Field of the Invention

The present invention relates to a polymeric-resin-coated papermaking-processing belt, such as that used to transfer a paper sheet between sections, or between elements of a given section, such as the individual presses in a press section, of the paper machine on which it is being manufactured, or to carry the sheet into other processes. Specifically, the present invention relates to a papermaking-processing belt having a base with a polymer coating on one side and a needled web on the other side.

2. Description of the Prior Art

Sheet transfer belts are designed both to carry a newly formed paper sheet through a portion of a paper machine, so as to eliminate open draws from the machine, and to release the sheet readily to a paper machine fabric, such as a press fabric or dryer fabric, or to another rotating element, such as a press roll or transfer roll, at some desired point in the machine. By definition, an open draw is an interval where the paper sheet passes from one component of the paper machine to another over a distance greater than the length of the cellulose fibers in the sheet without any support from a papermaker's fabric. By way of contrast, a closed draw is an interval where the paper sheet passes across such a distance supported by a papermaker's fabric or belt. The elimination of open draws removes a major cause of unscheduled paper machine shut-down, the breakage of the newly formed, and consequently weak, sheet at an open draw.

To work successfully, a sheet transfer belt must perform three critical functions on the paper machine: a) to remove the paper sheet from a press fabric without causing sheet instability problems; b) to cooperate with a press fabric in one or more press nips to ensure optimal dewatering and high quality for the paper sheet; and c) to transfer the paper sheet in a closed draw from one press in the press section to a sheet-receiving fabric or belt in the next press, or presses, in the press section, or to a dryer fabric in the dryer section.

A sheet transfer belt which successfully carries out these critical functions is disclosed in commonly assigned U.S. Pat. No. 5,298,124, entitled "Transfer Belt" and issued on Mar. 29, 1994, the teachings of which are incorporated herein by reference. The transfer belt disclosed therein has a surface topography characterized by a pressure-responsive, recoverable degree of roughness, so that, when under compression in a press nip, the degree of roughness will decrease, thereby permitting a thin, continuous water film to be formed between the transfer belt and a paper sheet to bond the paper sheet to the transfer belt upon exit from the press nip. When the original degree of roughness returns sometime after exit from the nip, the paper sheet may be removed from the transfer belt, perhaps with the assistance of a minimal amount of vacuum or suction, to a permeable fabric, such as a dryer fabric.

The sheet transfer belt disclosed in U.S. Pat. No. 5,298,124 comprises a reinforcing base with a paper side and a back side, and has a polymer coating, which includes a balanced distribution having segments of at least one polymer, on the paper side. The balanced distribution takes the form of a polymeric matrix which may include both hydrophobic and hydrophilic polymer segments. The polymer coating may also include a particulate filler. The reinforcing base is designed to inhibit longitudinal and transverse deformation of the transfer belt, and may be a woven fabric, and, in addition, may be endless or seamable for closing into endless form during installation on the paper machine. The reinforcing base may have one or more fiber batt layers attached by needling to its back side.

The fiber batt layer or layers, which may also be referred to as a needled web, are attached to the back side of the reinforcing base to control the impregnation of the polymer coating into the reinforcing base from the paper side during the manufacturing process. During the life of the transfer belt on a paper machine, the needled web protects the load-bearing yarns of the reinforcing base from damage by abrasion.

In practice, however, the needled web tends to hold paper particles during operation on a paper machine. Unfortunately, normal cleaning methods, such as the use of high-pressure water sprays during machine stoppages, have proven to be ineffective in removing the paper particles. As a consequence, paper particles build up on the surface of the needled web and become matted thereinto in the form of pill-like clumps of fiber and paper. These clumps tend to stick to stretch rolls and the like, which, in turn, pull them from the surface of the needled web along with some of the underlying needled web itself, thereby exposing the load-bearing yarns of the reinforcing base.

Moreover, larger clumps adhering to the surface of the needled web may cause the polymer coating on the paper side of the transfer belt, and possibly the reinforcing base itself, to be damaged by a surface doctor blade which is permanently fixed adjacent to a stretch roll or the like and cleans the paper side of the transfer belt running there-around. A larger clump of fiber and paper, carried on the inside, needled-web surface of the transfer belt and passing through the fixed gap separating the surface of the roll from the surface doctor blade, raises the transfer belt toward the surface doctor blade, which, being fixed, can then abrade or cut into the belt.

The object of the present invention is to remedy this situation by providing a transfer belt having a needled web on its inner surface, which needled web does not have a tendency to hold paper particles and is readily cleanable by normal cleaning methods.

SUMMARY OF THE INVENTION

Accordingly, in broad terms, the present invention is a polymeric-resin-coated papermaking-processing belt, such as a sheet transfer belt, comprising a reinforcing base in the form of an endless loop. The reinforcing base has a face side, which is the outside of the endless loop, and a back side, which is the inside of the endless loop. The face side may also be referred to as the paper side.

The face side of the reinforcing base is coated with a polymeric resin material, while the back side of the reinforcing base has a staple fiber batt attached thereto.

In contrast to the belts of this type in the prior art, the staple fiber batt on the back side of the reinforcing base has a smooth, fused surface which is free of protruding fiber ends. The smooth, fused surface is readily cleaned of paper particles and other materials that tend to accumulate on the inside of the belt during operation on a paper machine.

The present invention will now be disclosed in more complete detail in the discussion to follow, with appropriate reference being made to the figures identified below. Methods for manufacturing the inventive belt, including several ways for providing the staple fiber batt on the back side of the reinforcing base with the smooth, fused surface, will also be disclosed.

DETAILED DESCRIPTION OF THE PREFERRED EMBODIMENT

Figure 1:
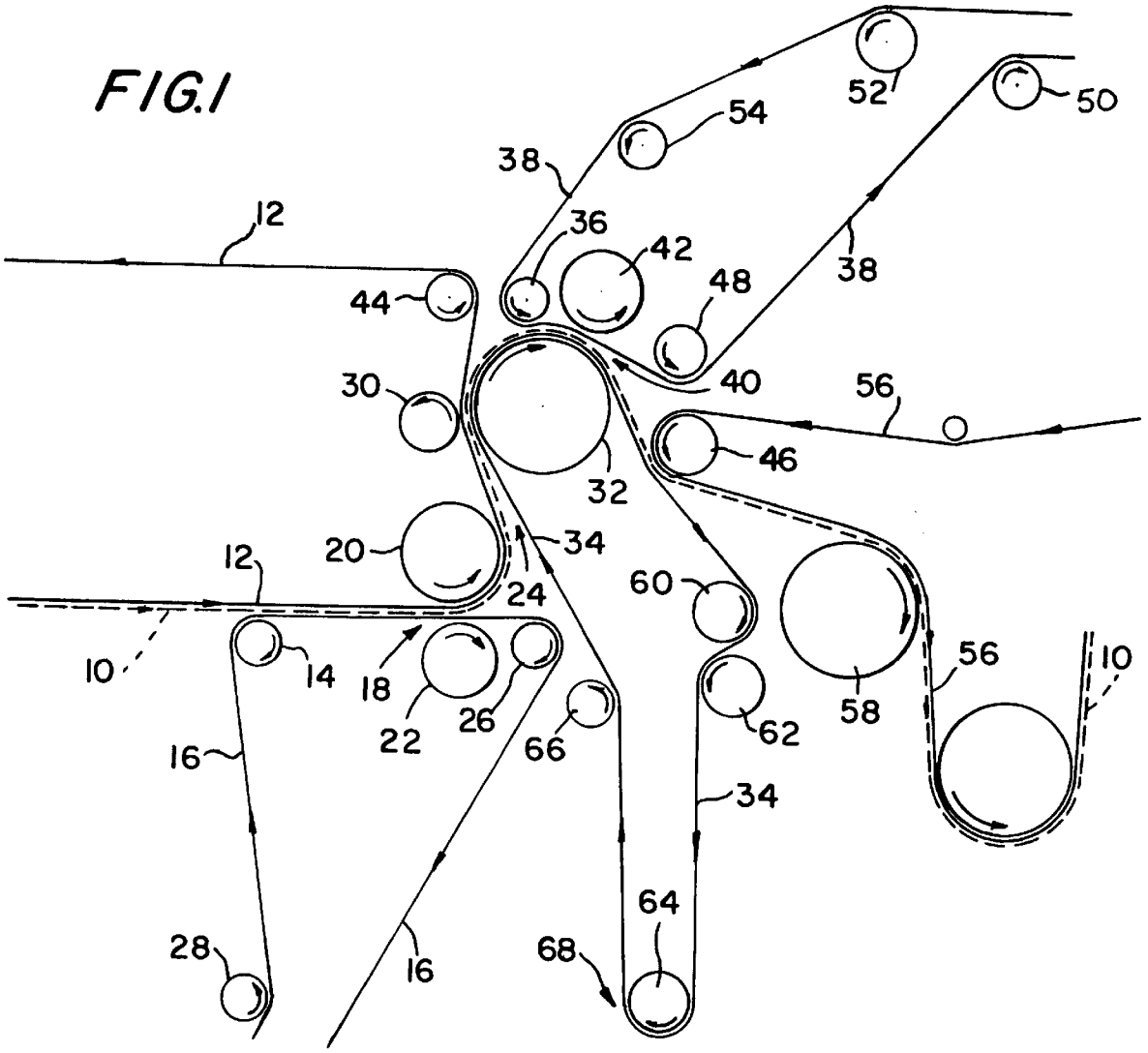
FIG. 1 is a schematic view of a representative press arrangement having a transfer belt for eliminating an open draw in a papermachine.

For purposes of illustration, FIG. 1 is a schematic view of a representative press arrangement which includes a transfer belt for eliminating an open draw. The arrows in FIG. 1 indicate the directions of motion or rotation of the various elements of the illustrated press arrangement.

Referring to the left side of FIG. 1, a paper sheet 10, represented by a dashed line, is shown as being carried on the underside of a first press fabric 12, which previously had removed the paper sheet 10 from the surface of a forming fabric, perhaps with the assistance of a suction pick-up roll.

Carried by the first press fabric 12, the paper sheet 10 proceeds toward the right to a first support roll 14, about which is trained and directed a second press fabric 16. Paper sheet 10, sandwiched between first press fabric 12 and second press fabric 16, proceeds from first support roll 14 onward toward the right to a first press nip 18 formed by a first press roll 20 and a second press roll 22.

Upon exit from first press nip 18, paper sheet 10 is carried by first press fabric 12 toward a second press nip 24. Second press fabric 16, separated from paper sheet 10 and first press fabric 12, proceeds toward second support roll 26 and back, by means of third support roll 28 and additional support rolls not shown, to first support roll 14, where it may again participate in the dewatering of paper sheet 10.

Second press nip 24 is formed by third press roll 30 and fourth press roll 32. Carried by first press fabric 12, the paper sheet 10 proceeds upward toward second press nip 24. A transfer belt 34 is trained about fourth press roll 32, and is directed through second press nip 24 with paper sheet 10 and first press fabric 12. In second press nip 24, the paper sheet 10 is compressed between first press fabric 12 and transfer belt 34.

Upon exit from second press nip 24, paper sheet 10 adheres to the surface of transfer belt 34, which surface is smoother than that of first press fabric 12. Paper sheet 10, now carried by transfer belt 34, proceeds from second press nip 24 to a fourth support roll 36, about which is trained and directed a third press fabric 38. Paper sheet 10, sandwiched between transfer belt 34 and third press fabric 38, proceeds onward to a third press nip 40 formed by fourth press roll 32 and a fifth press roll 42. First press fabric 12, separated from paper sheet 10 and transfer belt 34 after exiting from second press nip 24, is directed by means of fifth support roll 44 and additional support rolls not shown, to the point where it may again receive the paper sheet 10 from a forming fabric.

Upon exit from third press nip 40, paper sheet 10 again adheres to the surface of transfer belt 34, which surface is smoother than that of third press fabric 38. Paper sheet 10, again carried by transfer belt 34, proceeds downward from third press nip 40 to a vacuum transfer roll 46. Third press fabric 38, separated from paper sheet 10 and transfer belt 34 after exiting from third press nip 40, is directed by means of sixth, seventh, eighth and ninth support rolls 48,50,52,54, and additional support rolls not shown, to fourth support roll 36, where it may again participate in the dewatering of paper sheet 10.

Suction from vacuum transfer roll 46 through dryer fabric 56 removes paper sheet 10 from transfer belt 34 and places it on the surface of dryer fabric 56, which carries it toward the first dryer cylinder 58 of the dryer section.

Transfer belt 34, no longer carrying paper sheet 10 after vacuum transfer roll 46, proceeds therefrom downward to tenth and eleventh support rolls 60,62 and to stretch roll 64, and then upward to twelfth support roll 66 and eventually back to fourth press roll 32 and to second press nip 24, where it may again accept the paper sheet 10 from the first press fabric 12.

Transfer belt 34 allows the paper sheet 10 to be transferred from third press fabric 38 to dryer fabric 56 without an open draw. Paper sheet 10 is supported by a carrier at all points in its passage through the representative press arrangement depicted in FIG. 1, and is carried by transfer belt 34 upon exit from press nip 40 because a water film between the paper sheet 10 and the transfer belt 34 is strong enough to hold paper sheet 10 thereto.

Adjacent to stretch roll 64 is a surface doctor blade 68 which cleans the surface of the transfer belt 34. During the operation of the paper machine, wet and/or dry paper particles can migrate into the inside of the loop formed by the transfer belt and its support rolls. These particles can be carried in by water spray or air around the edges of the transfer belt. These particles, as discussed above, build up on the inside of the transfer belt 34, leading to the problems previously noted. In particular, a large clump of paper particles, passing around the stretch roll 64 on the inside of the transfer belt 34, can raise the transfer belt 34 toward the surface doctor blade 68, which, being in a fixed position, can then abrade or cut into the outer surface of the transfer belt 34.

Figure 2:
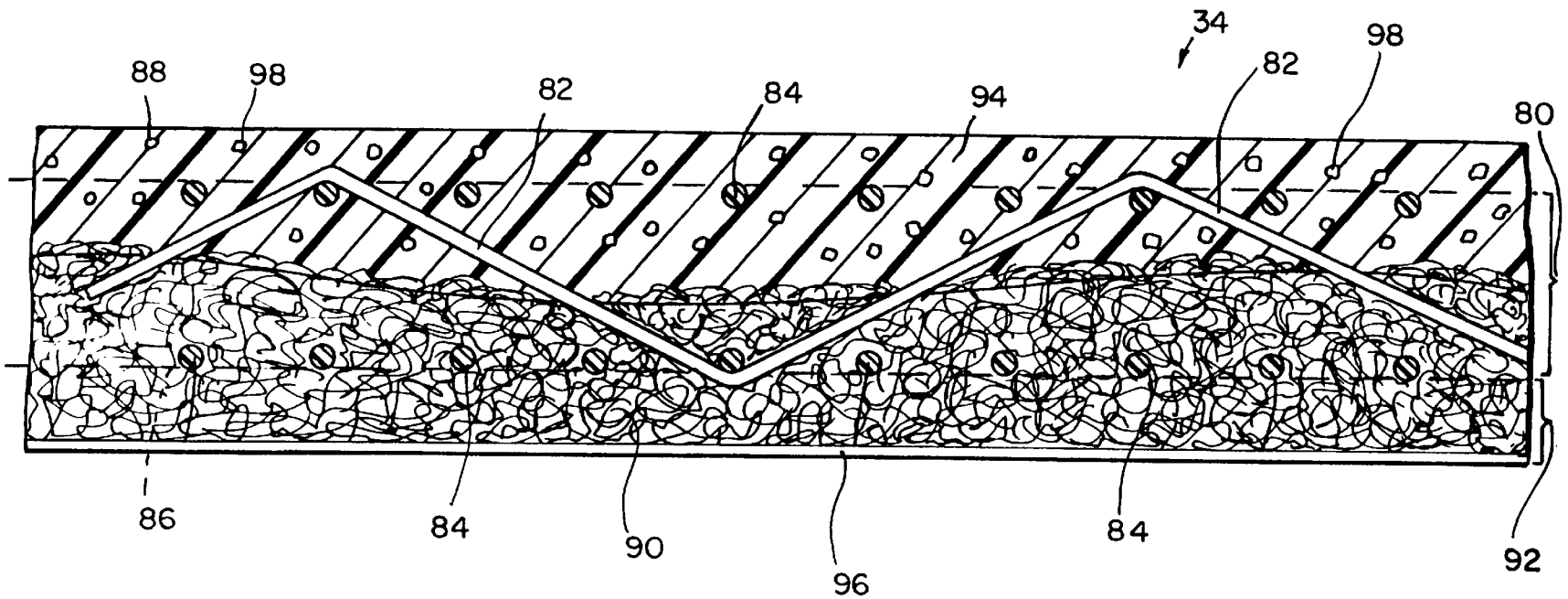
FIG. 2 is a cross-sectional view of the belt of the present invention.

A cross-sectional view of the transfer belt 34 of the present invention is shown in FIG. 2. The transfer belt 34 comprises a reinforcing base 80 which may be woven from warp yarns 82 and weft yarns 84 in the duplex pattern shown. The reinforcing base 80 has a back side 86 and a face, or paper, side 88, which are the inside and outside, respectively, of the endless loop formed by the reinforcing base 80. Where the reinforcing base 80 is woven endless, or woven using a modified endless weaving technique, the warp yarns 82 are oriented in the cross-machine direction of the reinforcing base 80, while the weft yarns 84 are in the machine direction thereof. Further, where a modified endless weaving technique is used, the weft yarns 84 provide seaming loops, not shown, for joining the reinforcing base 80 into endless form. Alternatively, the reinforcing base 80 may be flat-woven, and subsequently joined into endless form with a woven seam, or provided with seaming loops for joining the reinforcing base 80 into endless form. Where the reinforcing base 80 is flat-woven, the warp yarns 82 are oriented in the machine direction of the reinforcing base 80, while the weft yarns 84 are oriented in its cross-machine direction.

Although the reinforcing base 80 has been described above as being woven in a duplex pattern, it should be understood that it may be woven in other weave patterns known and commonly used by those of ordinary skill in the paper machine clothing arts, and that the duplex pattern shown above should be considered to be merely an example of the many weave patterns that may be used. Further, the reinforcing base 80 may alternatively be a nonwoven structure including reinforcing yarns oriented in the machine or longitudinal direction thereof and functioning as load-bearing yarns. The reinforcing base 80 may alternatively be a knitted fabric or other textile structure.

In any event, the back side 86 of the reinforcing base 80 has one or more layers of staple fiber batt 90 needled or otherwise attached thereto, for example, by hydroentanglement. The staple fiber batt 90, which may also be referred to as a needled web, penetrates at least partially through the reinforcing base 80 and forms a layer 92 on the back side 86 thereof. The staple fiber batt 90 may comprise a plurality of staple fibers of polymeric resin material, such as polyamide or polyester staple fibers, which are commonly used for this purpose by those of ordinary skill in the paper machine clothing arts.

The face side 88 of the reinforcing base 80 is coated with a polymer coating 94, which includes a balanced distribution having segments of at least one polymer. The balanced distribution takes the form of a polymeric matrix which may include both hydrophobic and hydrophilic polymer segments. The polymer coating 94 may also include a particulate filler 98, as disclosed in U.S. Pat. No. 5,298,124, the teachings of which are incorporated herein by reference.

The coating 94 is cured and subsequently ground to provide the transfer belt 34 with uniform thickness and with a desired surface topography.

The staple fiber batt 90 on the back side 86 of the reinforcing base 80 has a smooth, fused surface 96. The smooth, fused surface 96 is formed by heating the staple fiber batt 90 to a temperature above the melting point of its constituent staple fibers. Immediately thereafter, the reinforcing base 80 and staple fiber batt 90 are passed through a nip between a pair of rolls, which may be chilled to a temperature below the ambient. The rolls compress the reinforcing base 80 and the staple fiber batt 90. The heating fuses individual fibers on the surface of the staple fiber batt 90, and the subsequent compression produces a smooth, fused surface 96 with no protruding fiber ends without unduly compressing layer 92 as a whole. The smooth, fused surface 96 that results is easier to keep clean of paper particles and other undesirable materials that tend to accumulate during operation on a paper machine. While the fusion and subsequent compression of the surface of the staple fiber batt 90 partially seal it and reduce its permeability to water and air, sufficient permeability remains to permit the polymer coating 94, which is applied to the face side 88 of the reinforcing base 80, to penetrate into the staple fiber batt 90 and to be cured, if the smooth, fused surface 96 is produced before the polymer coating 94 is applied.

Several methods are available for treating the surface of the staple fiber batt 90 in the foregoing manner. The preferred method is a singe/compaction method.

Figure 3:
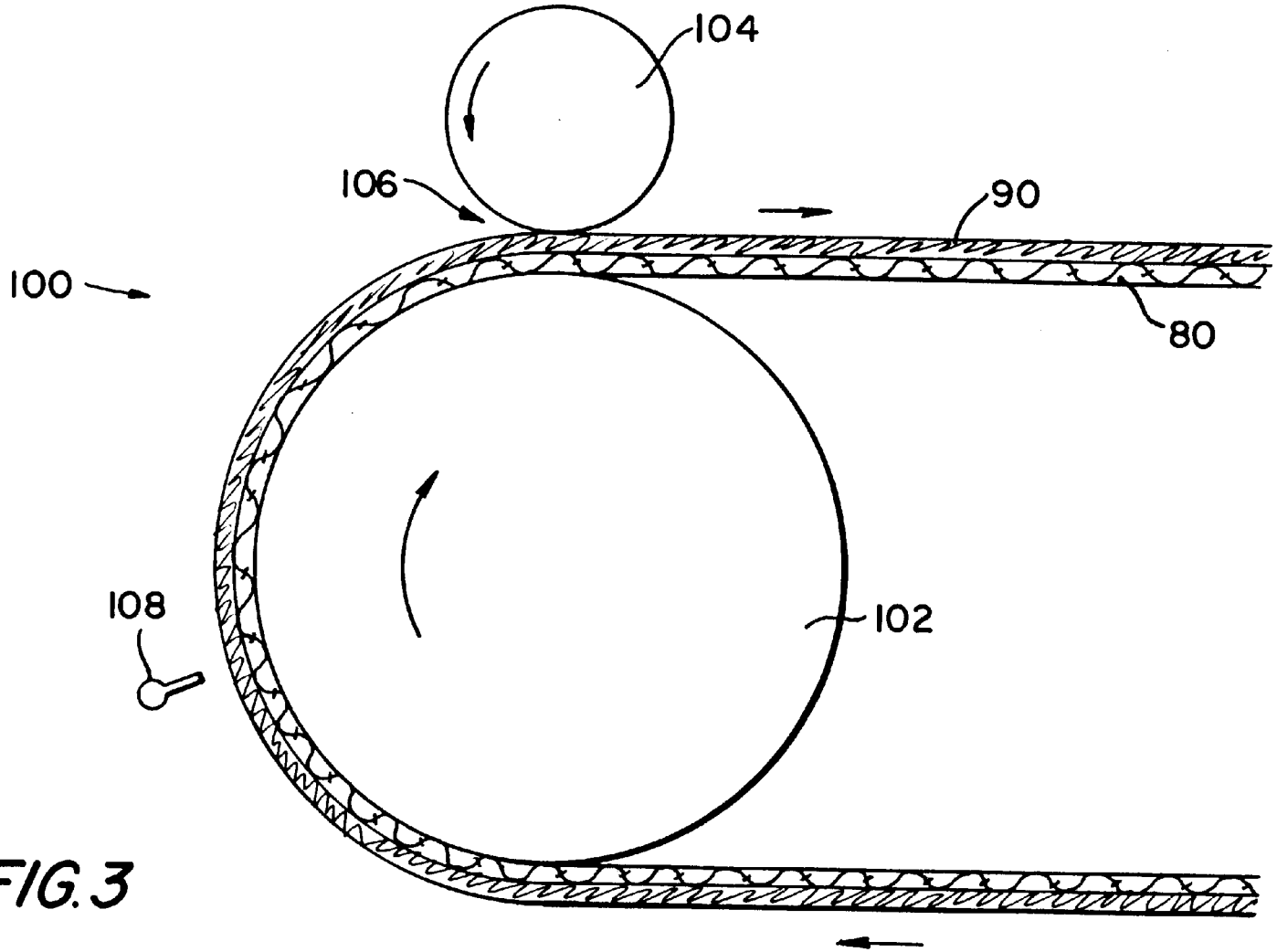
FIG. 3 is a schematic view of a singe/compaction apparatus which may be used in manufacturing the belt of the present invention.

An apparatus for practicing the singe/compaction method is depicted schematically in FIG. 3. The apparatus 100 comprises a backing roll 102, which may be the head roll or the tail roll of a finishing table. The reinforcing base 80, with staple fiber batt 90 attached thereto, is mounted on the finishing table with the staple fiber batt 90 facing outward. The backing roll 102, for example, may have a diameter of 1.2 m.

A compaction roll 104, which, for example, may have a diameter of 0.75 m, forms a nip 106 with the backing roll 102. The load of the compaction roll 104 against the backing roll 102 may be set at 35 kN/m (200 pli).

Some distance circumferentially from nip 106 on the backing roll 102 is a singeing head 108 which extends for the width of the backing roll 102. The singeing head 108 is propane-fired, and may be 1.25 m from nip 106 measured circumferentially around the backing roll 102 and 0.06 m (6.0 cm) from the surface of the backing roll 102. As was the case with FIG. 1 above, the arrows in FIG. 3 indicate the directions of motion or rotation of the various elements of the singe/compaction apparatus 100.

The apparatus 100 is first set to run at a speed of 25 m/min, thereby moving the reinforcing base 80 with staple fiber batt 90 attached thereto past the singeing head 108 at that speed. The singeing head 108 is ignited and singes the staple fiber batt 90 for three complete cycles, the first being at a speed of 25 m/min, the second being at a speed of 10 m/min, and the third being at a speed of 5 m/min. Shortly after each portion of the staple fiber batt 90 is singed, it passes through the nip 106 between the backing roll 102 and the compaction roll 104 for compaction. At the conclusion of the three cycles, the singeing head 108 is extinguished and the compaction roll 104 is disengaged. The reinforcing base 80 with the smooth, fused fiber batt surface is then removed from apparatus 100, and is inverted for subsequent coating with polymer coating 94.

Figure 4:
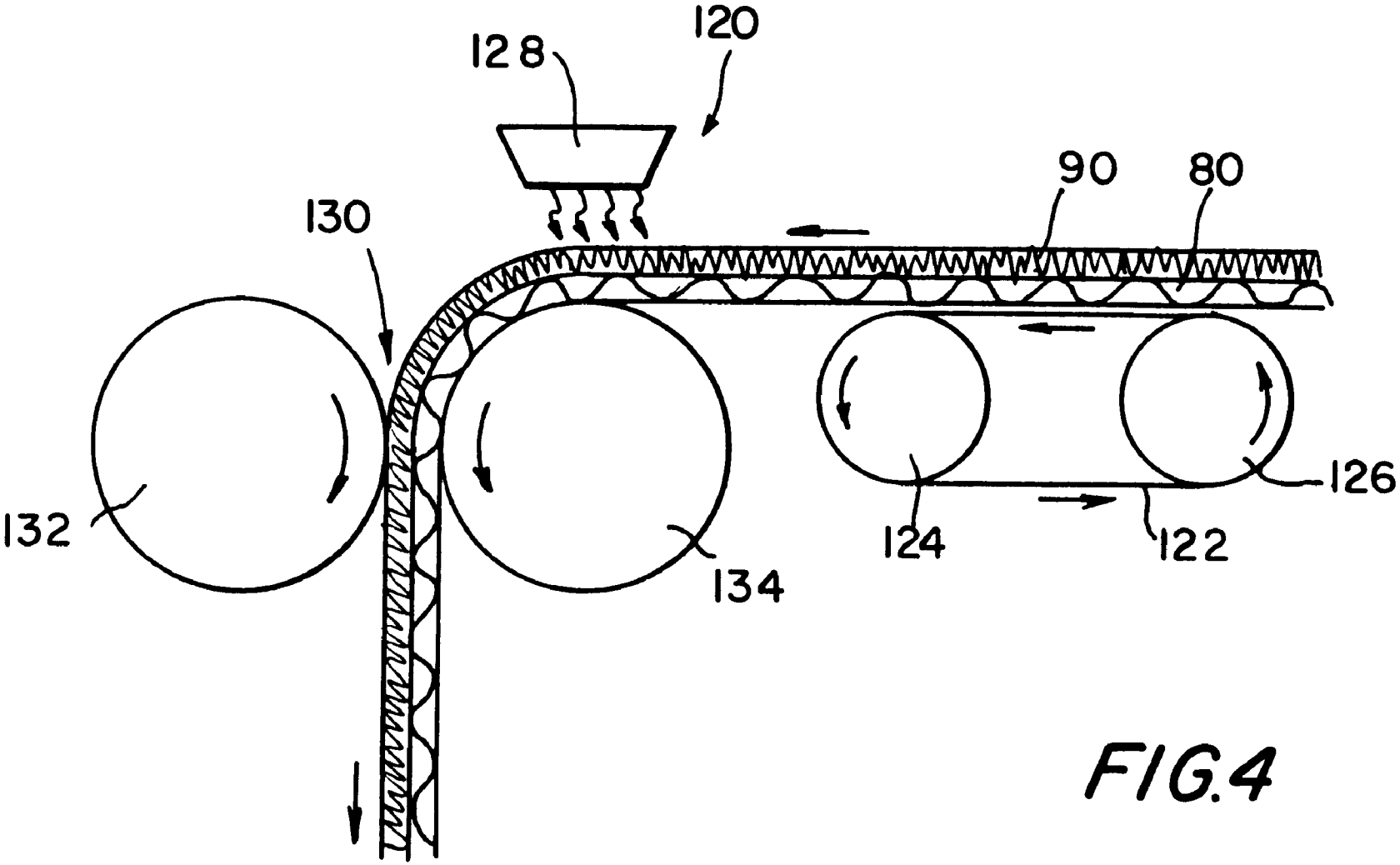
FIG. 4 is a schematic view of an alternate apparatus which may be used in manufacturing the belt of the present invention.

An alternate method for treating the surface of staple fiber batt 90 is infrared heating followed by calendering, an apparatus for which is depicted schematically in FIG. 4. The apparatus 120 comprises a conveyor having an endless belt 122 trained about a first roll 124 and a second roll 126. The conveyor carries reinforcing base 80 and staple fiber batt 90 attached thereto toward a source 128 of infrared radiation. The infrared radiation is of an intensity sufficient to fuse individual fibers on the surface of staple fiber batt 90. Immediately thereafter, reinforcing base 80 and staple fiber batt 90 pass through a nip 130 formed by a first chilled calender roll 132 and a second chilled calender roll 134. The gap between the chilled calender rolls 132, 134 is fixed at a distance which will smooth the fused surface of the staple fiber batt 90 without unduly compressing it. As was the case with FIGS. 1 and 3 above, the arrows in FIG. 4 indicate the directions of motion or rotation of the various elements of the apparatus 120 used for infrared heating followed by calendering.

It should be understood that the smooth, fused surface 96 of the staple fiber batt 90 may be provided through the practice of alternate techniques without departing from the scope of the present invention. For example, instead of using singeing head 108 or source 128 of infrared radiation to fuse individual fibers on the surface of staple fiber batt 90, a source of ultrasonic energy could be used to similar advantage. In such a situation, the ultrasonic energy is delivered through a horn, which contacts the surface of the staple fiber batt and vibrates at a frequency higher than the human ear is able to detect. The vibrations of the horn cause the region of the surface with which it is in direct contact to heat in an amount sufficient to fuse its component fibers, including protruding fiber ends. Mechanical pressure between the horn and an underlying anvil compacts the fused fibers, thereby providing the staple fiber batt with a smooth, fused surface free of protruding fiber ends.

Moreover, it should also be understood that, where staple fiber batt 90 must be on the outside of the reinforcing base 80 to be fused and compacted, that is, where the reinforcing base 80 must subsequently be inverted to place staple fiber batt 90 on the inside surface thereof, the fusion and compaction of the individual fibers on the surface of the staple fiber batt 90 must be effected before the polymer coating 94 is applied. However, where the configuration of the apparatus would permit the staple fiber batt 90 to be treated in its ultimate position on the inside of the reinforcing base 80, inversion would not be necessary and the coating could be applied before or after the fusion/compaction operation.

While particular emphasis has been given in the preceding discussion to the application of the present invention to a transfer belt, it should be understood that the present invention may be applied to a long nip press (LNP) belt or to any other polymer-coated belt for the paper industry, such as a calender belt.

Modifications to the above would be obvious to those of ordinary skill in the art, and would not bring the invention so modified beyond the scope of the appended claims.

What is claimed is:

1. A polymeric-resin-coated papermaking-processing belt comprising:

a reinforcing base, said reinforcing base being in the form of an endless loop and having a face side, said face side being the outside of said endless loop, and a back side, said back side being the inside of said endless loop;

a coating of a polymeric resin material on said face side of said reinforcing base; and a staple fiber batt attached to said back side of said reinforcing base, said staple fiber batt having a smooth, fused surface, said surface being free of fiber ends protruding from said staple fiber batt.

2. A belt as claimed in claim 1 wherein said reinforcing base is a woven fabric.

3. A belt as claimed in claim 2 wherein said woven fabric is woven endless.

4. A belt as claimed in claim 2 wherein said woven fabric is woven in a modified endless weaving technique and joined into endless form with a seam.

5. A belt as claimed in claim 2 wherein said woven fabric is flat-woven and joined into endless form with a woven seam.

6. A belt as claimed in claim 1 wherein said reinforcing base is a nonwoven fabric.

7. A belt as claimed in claim 1 wherein said staple fiber batt is attached to said reinforcing base by needling.

8. A belt as claimed in claim 1 wherein said staple fiber batt is attached to said reinforcing base by hydroentangling.

9. A belt as claimed in claim 1 wherein said staple fiber batt comprises a plurality of staple fibers of a polymeric resin material.

10. A belt as claimed in claim 9 wherein said polymeric resin material is selected from the group consisting of polyamide and polyester resins.

11. A method for manufacturing a polymeric-resin-coated papermaking-processing belt comprising the steps of:

providing a reinforcing base, said reinforcing base being in the form of an endless loop having a first side and a second side;

attaching a staple fiber batt to one of said first and second sides of said reinforcing base;

heating said staple fiber batt at a temperature sufficient to fuse individual fibers on the surface of said staple fiber batt and fiber ends protruding therefrom;

compressing said staple fiber batt after said heating step to adhere said protruding fiber ends to said individual fibers on said surface of said staple fiber batt and to smooth said surface;

coating the other of said first and second sides of said reinforcing base with a polymeric resin material; and curing said polymeric resin material to produce said polymeric-resin-coated paper-processing belt.

12. A method as claimed in claim 11 wherein said steps are carried out in the listed order.

13. A method as claimed in claim 11 wherein said coating and curing steps are carried out before said heating and compressing steps.

14. A method as claimed in claim 11 wherein said attaching step is accomplished by needling said staple fiber batt into one of said first and second sides of said reinforcing base.

15. A method as claimed in claim 11 wherein said attaching step is accomplished by the hydroentanglement of said staple fiber batt into one of said first and second sides of said reinforcing base.

16. A method as claimed in claim 11 wherein said heating step is performed by exposing said staple fiber batt to a singeing head.

17. A method as claimed in claim 11 wherein said heating step is performed by exposing said staple fiber batt to infrared radiation.

18. A method as claimed in claim 11 wherein said heating step is performed by exposing said staple fiber batt to a source of ultrasonic energy and said compressing step is performed by pressing said staple fiber batt and reinforcing base with said source against an underlying anvil.

19. A method as claimed in claim 11 wherein said compressing step is performed by passing said staple fiber batt and reinforcing base through a nip formed by a backing roll and a compaction roll.

20. A method as claimed in claim 11 wherein said compressing step is performed by passing said staple fiber batt and reinforcing base through a nip formed by a pair of calender rolls.

21. A method as claimed in claim 20 wherein said nip is a gap of fixed width.

22. A method as claimed in claim 20 wherein said calender rolls are chilled to a temperature below the ambient temperature.

23. A method as claimed in claim 11 further comprising the step of grinding said polymeric resin material subsequent to said curing step to make said polymeric-resin-coated paper-processing belt uniformly thick and to impart desired surface characteristics thereto.

* * * * *